United States Patent [19]

Fischer

[11] Patent Number: 4,903,843

[45] Date of Patent: Feb. 27, 1990

[54] FOIL SHEATH FOR OBJECTS, ESPECIALLY PACKAGES OF GOODS

[75] Inventor: Jules Fischer, Widen, Switzerland

[73] Assignee: Folien Fischer AG, Switzerland

[21] Appl. No.: 171,848

[22] Filed: Mar. 22, 1988

[30] Foreign Application Priority Data

Mar. 25, 1987 [CH] Switzerland ..... 01131/87

[51] Int. Cl.[4] ..... B65D 75/62

[52] U.S. Cl. ..... 206/609; 206/497; 206/611; 206/616

[58] Field of Search ..... 53/399, 442, 443; 206/303, 445, 608–611, 612, 632, 633, 616; 229/87.2, 89

[56] References Cited

U.S. PATENT DOCUMENTS

| | | | |
|---|---|---|---|
| 3,047,140 | 7/1962 | Robins | 206/497 |
| 3,259,235 | 7/1966 | Sowle | 206/497 |
| 3,260,358 | 7/1966 | Gottily et al. | 206/633 |
| 3,358,902 | 12/1967 | Emmert et al. | 53/442 |
| 3,456,780 | 7/1969 | Forman | 206/497 |
| 3,669,255 | 6/1972 | Raymus | 206/497 |
| 4,184,309 | 1/1980 | Amberg | 53/399 |
| 4,691,835 | 9/1987 | Mueller | 215/246 |
| 4,696,394 | 9/1987 | Estkowski et al. | 206/303 |
| 4,706,839 | 11/1987 | Spence | 206/497 |

FOREIGN PATENT DOCUMENTS

| | | | |
|---|---|---|---|
| 1276091 | 10/1961 | France | 206/497 |
| 2598389 | 11/1987 | France | 206/497 |
| 3000061 | 1/1988 | Japan | 206/497 |
| 1277468 | 6/1972 | United Kingdom | 206/303 |

*Primary Examiner*—Jimmy G. Foster

*Attorney, Agent, or Firm*—Tarolli, Sundheim & Covell

[57] ABSTRACT

A sheath for wrapping objects has a sheath body which extends over a circumferential surface (4) of an object (1) and comprises at least portions of a shrink foil pre-stretched in a circumferential direction. The sheath has a significant cohesion of the sheath body, is easy to tear off, and is characterized by low production costs. At least one foil edge (5*a*) is provided with a pair of pre-formed predetermined tear zones (7) which extend in the rim portion (6*a*) of the foil edge with a limited depth and are mutually spaced circumferentially. The tear zones have a reduced tear and/or separation resistance as compared with adjacent foil portions.

13 Claims, 4 Drawing Sheets

FOIL SHEATH FOR OBJECTS, ESPECIALLY PACKAGES OF GOODS

The invention relates to a foil sheath for wrapping objects, especially packages of goods, and comprising a sheath body which encircles the circumferential surface of an object and is made at least partially from a shrink foil pre-stretched in a circumferential direction.

Foil sheaths of the kind specified are widespread in public use for packaging goods of various kinds, especially boxes, bottles or the like, mainly cylindrical or having a cylindrical section and are, thus, known. The sheath covers, in many cases, a seal or a premanufactured opening notch of a package and, thus, also protects the integrity of the content of the package, which is important to the consumer. Without special provisions, separation of the sheath, necessary to open the package, because of the tear resistance and bonding strength of the sheath foil, which are generally considerable, is inconvenient and often difficult. It is often customary, therefore, to provide the sheath with tear strings or tear strips. This results in considerable cost in mass production of such sheaths. Also, the rapid finding and grasping of the pull section of such tear elements are relatively inconvenient, unless rather long pull sections protruding from the sheath are provided and which are usually undesirable for reasons of appearance. Perforations, extending through the whole sheath, are also quite commonly used as an opening aid. The perforations can be produced with relatively little expense, but are associated with an undesirable weakening of the sheath especially in view of the tense condition of a shrunken foil. Also, grasping of extremely narrow tear notches and tearing by hand is inconvenient.

The object of the invention, therefore, is to provide a foil sheath characterized by practically undiminished strength, by simple tear-off means, and by low cost of production. The object of the invention is achieved by providing in a sheath of the kind mentioned on at least one foil edge portion of the sheath body, at least one pair of preformed predetermined tear zones which extend in the rim portion of the foil, extend a limited length in the rim portion, are mutually spaced in the circumferential direction of the wrapped object, and have, in comparison with adjacent portions of the foil sheath, a reduced resistance to tearing and/or separation.

Providing predetermined tear zones limited in their length relative to the foil rim portion results in low production cost, and makes possible, as extensive studies have shown, and surprisingly, even without weakening the foil extending over the wrapped body, a reliable and complete separation of the sheath which can be performed manually and with little force. This becomes possible due to the anisotropy resulting from prestretching the foil in the circumferential direction which causes an increase in tear resistance is a direction parallel to the stretching direction, but a decrease of tear resistance in a direction transverse to the stretching direction, that is, in the direction of the predetermined tear zones. Naturally, a suitable selection from among available foil materials is necessary, to exclude, generally, too high a resistance to further tearing. In further development of the invention, it has been found that polystyrol-based plastic is an especially appropriate material for the manufacture of the foil sheaths according to the invention.

A further object of the invention is to provide foil rim portions having predetermined tear zones of the kind specified above and which insure wrapping of packages in a satisfactory manner and appearance. The object of the invention is achieved by providing a foil sheath for objects, especially packages, which has a sheath body which circumscribes a circumferential surface of an object and preferably is formed from a shrink foil, prestretched in the circumferential direction of the package. The sheath body has at least one circumferential edge portion defining a rim portion extending around an end surface of the wrapped object having a closing portion which lies beneath the respective circumferential edge portion of the sheath. In connection with these features, the object of the invention is achieved by providing at least at one of the end surfaces of the package a slide-type cover element having its outer rim located between the circumferential edge of the package and the foil rim portion.

These features make possible a design, largely independent of the actual conditions of the end surface of the package and of the shape of the end surface of the package. Especially they make possible utilization of a cover for a wrapped object which is convenient in handling and use, namely, for packages of goods with an end surface located below the end surface of the cover. A package having an end surface that lies below an end surface of a cover is represented, for example, by conventional cans having a cover made of plastic material and having a cylindrical rim having a radially projecting end edge section lying against the rim of a can. There are formed, through insertion of a disc-shaped cover element, not only a smooth end lock for a package which is resistant to accumulation and penetration of impurities, but also a closed empty space which provides for placing in addition to the contents of the package such objects as small spoons or the like, advertising inserts, and other objects. To this end, the cover element appropriately consists of a transparent or translucent material. Otherwise, the cover element may have any desired three-dimensional form or may have a concave or convex arc, for example, or may have a relief pattern. In any case, the important advantage consists in that the insertion and holding of the cover element does not involve any appreciable extra cost.

The invention is explained below with reference to the preferred embodiments schematically represented in the drawings.

Figure 6:
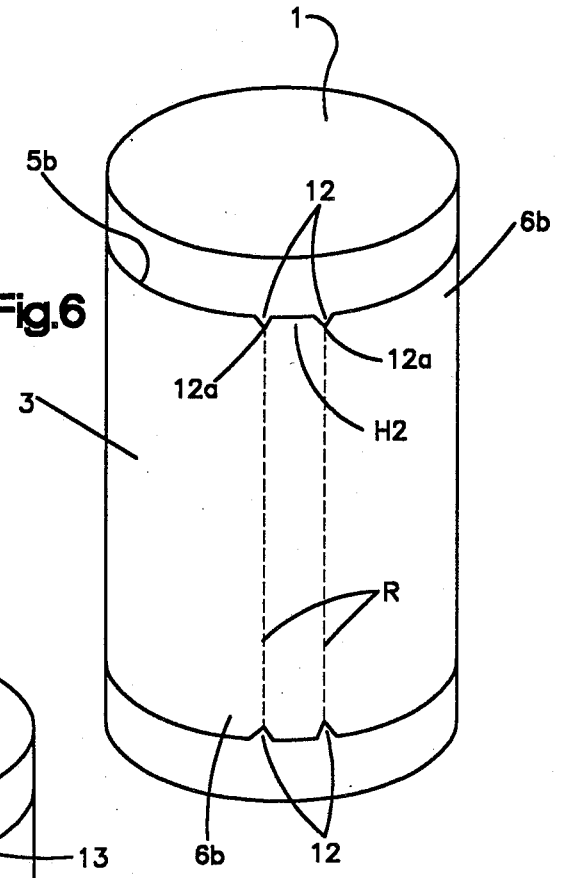
Figure 7:
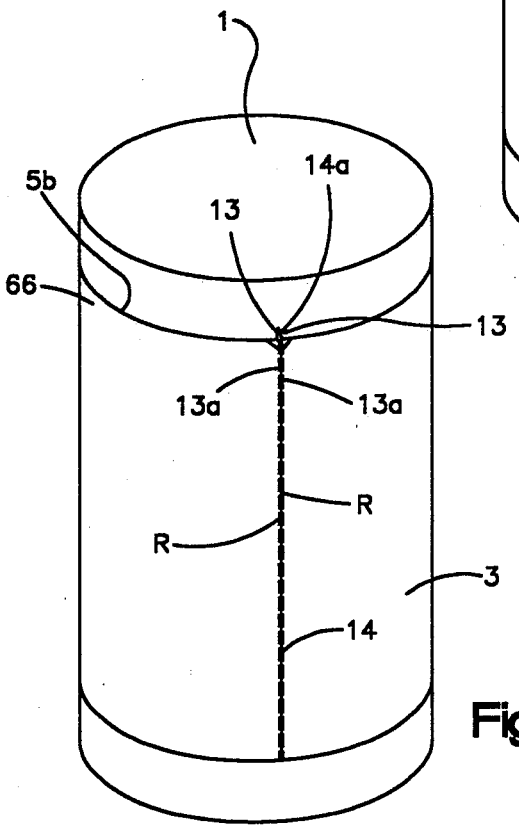
Figure 8:
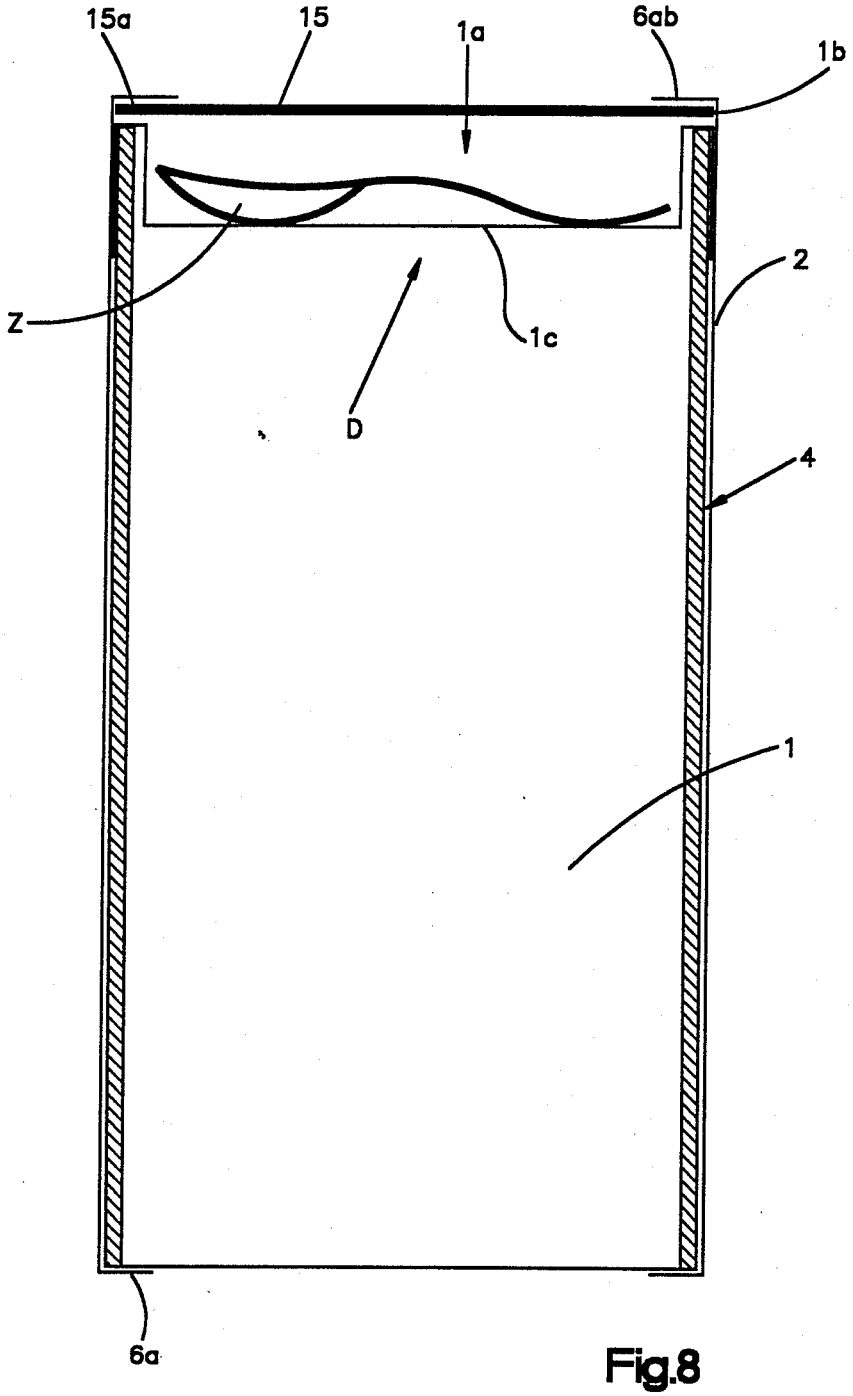

FIGS. 6 and 7 each shows embodiments of a cylindrical package having a cylindrical foil sheath with predetermined tear zones and a hand-pull section designed in a special way to effect tearing of the sheath; and FIG. 8 is an axial cross-section of a cylindrical package having a cover located in an end opening with axially lower-lying end closing portion, and with a cover element located in a foil sheath.

Figure 1:
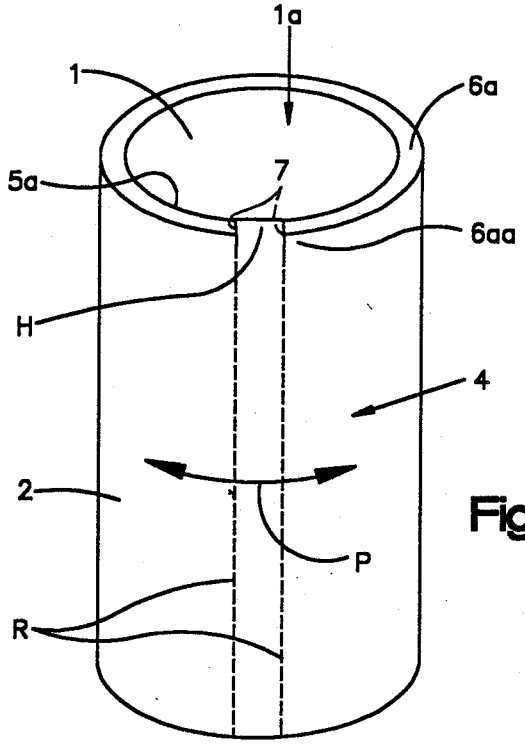
FIG. 1 is a perspective view of a cylindrical package with a foil sheath encircling end edges of the package and having predetermined corresponding tear zones.

In the package shown in FIG. 1, a shaped package body 1 is surrounded by a sheath 2 made from a shrink foil and extending over circumferential surface 4 of the package body. The foil of the sheath is pre-stretched circumferentially, in the direction of arrow P, over the package body 1. Such circumferential stretching is obtained, for example, as a result of manufacturing of the sheath from a foil band stretched in its lengthwise direction, which sheath extends circumferentially about an object to be wrapped and, in a manner, known per se and not shown here, is joined along axially extending junction surface by welding or gluing.

The sheath 2 has on opposite sides thereof foil rim portions (6*a*) which grip over the circumferential edges 1*b* of the end surfaces 1*b* of the package body. The upper foil rim portion 6*a*, seen in FIG. 1, is provided with two predetermined tear zones 7 circumferentially spaced from each other and comprising each a row of points of weakness that extends from the foil edge 5*a* at an angle (here substantially at a right angle) radially across the rim portion 6*a* and around the edge 1*b*, but is limited by the rim zone 6*aa* located adjacent this edge.

In the present case, the predetermined tear zones consist of indentations and a hand-pull section therebetween which hand-pull section projects from a foil surface as a result of foil tension and can be conveniently grasped by hand. As a result of a relatively light pull upward and outward and facilitated by the tension of the foil itself in the direction of the arrow P, there are formed, in the sheath within the unweakened foil zone on the circumferential surface 4 thereof, continuous tear lines R which, according to experience, retain their axial-parallel initial directions determined by the predetermined tear zones, and lead to a complete separation of the sheath.

Figure 2:
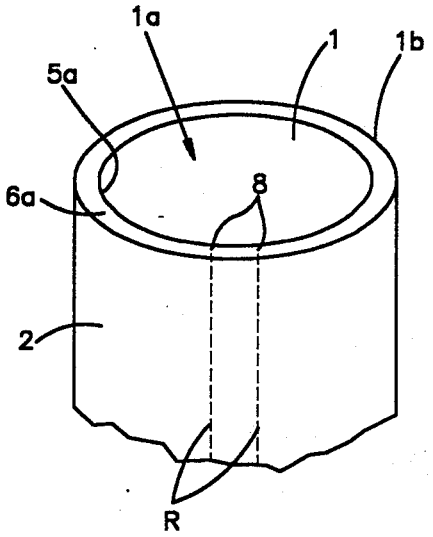
FIG. 2 is an upper part of a cylindrical package with a foil sheath, similar to FIG. 1, but with modified predetermined tear zones.

Since the foil edge 5*a* at the end zone of the package body is easily accessible and, even under the action of its own tension, is usually easily lifted from the end surface of the package body, then, according to FIG. 2, shorter predetermined tear zones 8 not gripping around the circumferential edge 1*b*, may be provided. This especially simplifies production of the foil sheath.

Figure 3:
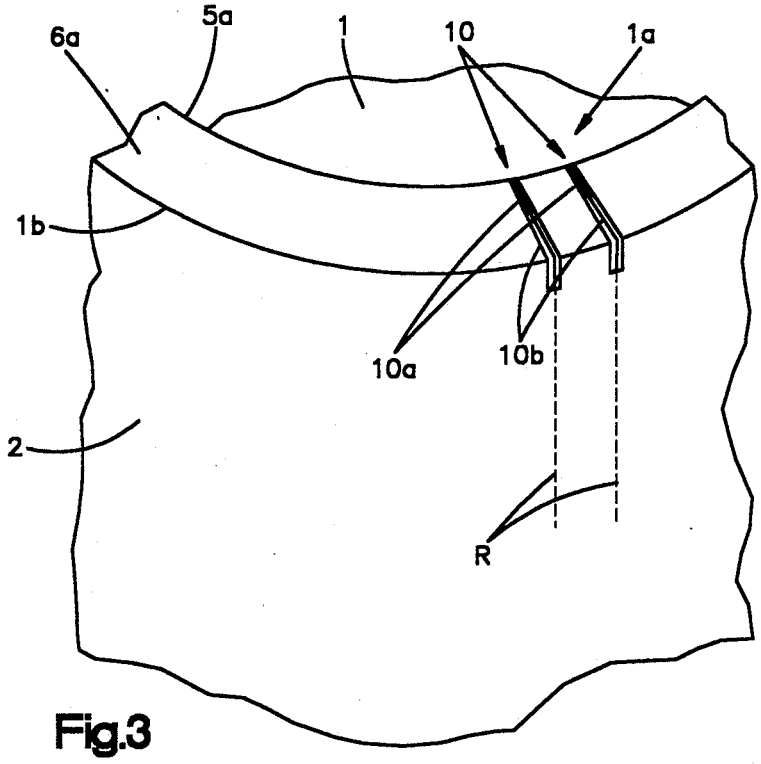
FIG. 3 is on a larger scale, an upper part of a cylindrical package with a foil sheath encircling end edges of the package and having further modified predetermined tear zones.

If it is desired to eliminate a projecting hand-pull section then predetermined tear zones 10 according to FIG. 3, may be advantageously provided which are designed as notched channels able to preserve the cohesion of the foil portion 6*a*. Without much additional expenses, short cuts 10*a* gripping around the edge can be formed in the foil edge 5*a* to which notched channel sections 10*b* of the predetermined tear zones are connected.

Figure 4:
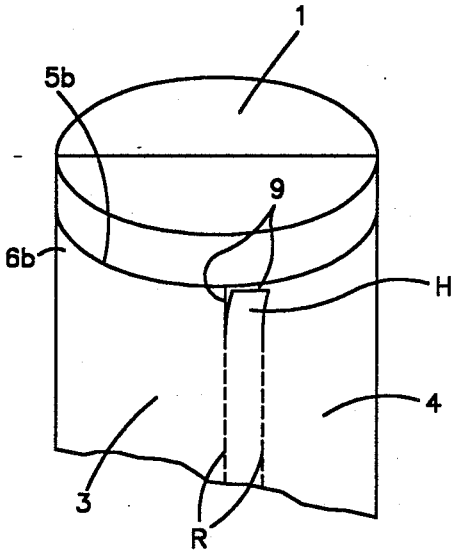
FIG. 4 is an upper part of a cylindrical package with a foil sheath having only a cylindrical circumferential surface and predetermined tear zones formed thereon.

In the embodiment according to FIG. 4, the foil edge 5*b* together with the rim portion 6*b* of a cylindrical sheath 3 is located on the circumferential surface 4 of the sheath. Here, the tension of the foil when the predetermined tear zone 9 is designed as indentations, as shown, generally results in a marked separation of the hand-pull section H. There are formed here also, according to experience, in the absence of continuous rows of points of weakness in the sheath, axial parallel continuous tear lines R.

Figure 5:
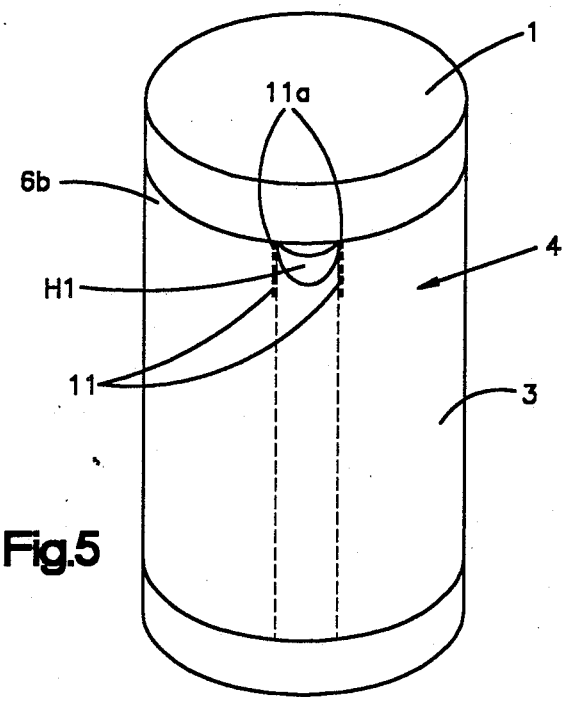
FIG. 5 is a cylindrical package with a foil sheath according to FIG. 4, but with a special design of the predetermined tear zones and of the portion of the foil rim zone.

In the embodiment according to FIG. 5, the predetermined tear zones 11 are designed as limited rows of perforations on the foil rim portion which are able to preserve the cohesion of the foil edge 5*b*. This permits forming of a hand-pull section H1 extending out from the circumferential surface 4 of the package body 1 in the form of a rounded bulge on the foil rim portion 6*b*. In this way, a specially convenient handling is possible. Such a foil bulge can be formed during the production of the foil band by a relatively simple pressing process. Here also, if desired, additional short cuts 11*a* which do not substantially impair the cohesion of the foil edge, may be provided and which, in the case of thicker foils, facilitate tearing.

In the embodiments according to FIGS. 6 and 7, again, cylindrical sheaths 3 are provided with triangular cut-outs 12 and 13 having sharp inner edges 12*a* and 13*a* forming the predetermined tear zones. This design offers certain advantages in production and, in the case of the design according to FIG. 6, provides for forming of a uniform projecting hand-pull section H2 of an attractive shape.

In the embodiment according to FIG. 7, on the other hand, between the cut-outs 13 extending closely side-by-side, without additional expenses, a thread-like tear element 14 in the form of a lengthwise welding seam is formed. In particular, with a connection, known per se, of the sheath formed from a continuous foil band by means of separation welding, a suitable seam is formed both sides of which, without further means, form continuous tear lines R. Between the cut-outs of the predetermined tear zones 13, there is formed, also without special means, a projecting portion 14*a* of the same body, which represent a convenient hand-pull section for tearing-off the sheath.

In the embodiment according to FIG. 8, an opening at the end 1*a* of the package 1 is closed by an insert cover D. This cover has a lower-lying closing part 1*c*, in relation to the respective circumferential edge 1*b*. A sheath body 2 of the type shown in FIG. 1 grips around, by a lower or upper foil rim zone 6*a* or 6*ab*, the corresponding circumferential edge of the package. Between the upper circumferential edge 1*b* of the package, and the respective foil rim portion 6*ab*, a circumferential rim 15*a* of a cover 15 is located. In the hollow space HR thus formed at the end 1*a*, an additional product Z, is placed, for example, a spoon, or an advertising insert, or an advertising gift. Such a cover element may be provided with advantage, even in packages with closed and even with flat shaping of an end surface. Here, in particular, a spatially projecting relief or cup-type shaping of the cover element, again with the formation of a useful empty space, may be considered.

I claim:

1. A foil sheath for an object, especially a package of goods, comprising:

a sheath body (2, 3) for enveloping a circumferential surface (4) of the object, said sheath body being formed at least partially of a shrink foil prestretched in a circumferential direction, the sheath body having at least one foil edge (5*a*, 5*b*) and having a foil rim portion (6*a*, 6*b*) located adjacent to the foil edge; and at least one pair of predetermined tear zones (7–13) extending into the foil rim portion located adjacent to the foil edge, the predetermined tear zones extending along a limited length in the foil rim portion and being circumferentially spaced on the wrapped object (1), the predetermined tear zones having a reduced tear and/or separation resistance as compared to adjacent portions of the foil.

2. A foil sheath according to claim 1 wherein the foil rim portion (6*a*) of the sheath body (2) extending along a circumferential edge (1*b*) of the wrapped object and grips around the circumferential edge, the circumferential edge defining a first part of the foil rim portion on one side of the circumferential edge and defining a second part (6*aa*) of the foil rim portion on the opposite side of the circumferential edge, the first part of the rim portion being located adjacent to the foil edge of the sheath body and the second part of the foil rim portion being located at the circumferential surface of the object, the predetermined tear zones (7, 9, 10) extending from the foil edge into the second part of the foil rim portion.

3. A foil sheath according to claim 1 or 2, wherein the predetermined tear zones (7–13) are formed of points of weakness stretched lengthwise and extending at an angle to the foil edge (5*a*, 5*b*).

4. A foil sheath according to claim 1 or 2, wherein the predetermined tear zones (7, 8, 9, 10*a*) extend across the foil edge (5*a*, 5*b*).

5. A foil sheath according to claim 1 or 2, wherein the predetermined tear zones (11) have rows of perforations.

6. A foil sheath according to claim 1 or 2 wherein the predetermined tear zones (10*b*) have notched channels.

7. A foil sheath according to claim 1 wherein the predetermined tear zones (12, 13) have flat cut-outs, projecting from the foil edge (5*b*) of the foil and of which the contour engaging the foil rim portion (6*b*) forms a sharply bent notched tear point (12*a*, 13*a*).

8. A foil sheath according to claim 7 wherein the flat cut-outs of the predetermined tear zones (12, 13) have a triangular cross-section.

9. A foil sheath according to claim 1 wherein in the foil rim portion (6*b*) between two adjacent predetermined tear zones (11), a bulge (11*a*) projecting from the circumferential surface (4) of the wrapped object (1) is formed.

10. A foil sheath according to claim 1 wherein in the foil rim portion (6*b*) between two adjacent predetermined tear zones (13), the sheath body (3) has a cord or a thread-form tear trip (14) extending transverse to the foil edge (5*b*).

11. A foil sheath according to claim 10 wherein the tear strip (14) extends along the whole width of the sheath body (3).

12. A foil sheath according to claim 10 wherein the tear strip (14) is formed by a welding seam especially of the sheath body (3).

13. A foil sheath according to claim 1 wherein the sheath body is formed of a polystyrol based plastic material.

* * * * *

UNITED STATES PATENT AND TRADEMARK OFFICE

CERTIFICATE OF CORRECTION

PATENT NO. : 4,903,843

DATED : February 27, 1990

INVENTOR(S) : Jules Fischer

It is certified that error appears in the above-identified patent and that said Letters Patent is hereby corrected as shown below:

Column 5, Line 6, Claim 2, change "extending" to --extends--

Column 6, Line 19, Claim 10, change "trip" to --strip--

Signed and Sealed this

Twelfth Day of March, 1991

*Attest:*

HARRY F. MANBECK, JR.

*Attesting Officer*

*Commissioner of Patents and Trademarks*